United States Patent [19]

Kakiuchi et al.

[11] Patent Number: 4,970,042

[45] Date of Patent: Nov. 13, 1990

[54] SYNTHETIC FIBERS HAVING UNEVEN SURFACES METHOD FOR MELT-SPINNING

[75] Inventors: Hiroshi Kakiuchi; Setsuo Fukuhara, both of Kanagawa; Michinobu Fujiwara, Chiba; Hiroshi Maeda, Tokyo; Yutaka Shirakashi, Tokyo; Osamu Asakura, Tokyo; Yoshihiro Yoneda, Tokyo; Tetsuo Noda, Tokyo; Naoyuki Fujita, Tokyo, all of Japan

[73] Assignee: Aderans Co., Ltd., Tokyo, Japan

[21] Appl. No.: 393,051

[22] Filed: Aug. 8, 1989

Related U.S. Application Data

[60] Continuation of Ser. No. 140,116, Dec. 31, 1987, abandoned, which is a division of Ser. No. 941,351, Dec. 15, 1986, Pat. No. 4,792,489.

[30] Foreign Application Priority Data

Dec. 27, 1985 [JP] Japan ..... 60-298137
Dec. 27, 1985 [JP] Japan ..... 60-298138

[51] Int. Cl.[5] ..... B29C 47/00; D01D 5/08

[52] U.S. Cl. ..... 264/177.13; 264/177.19; 264/178 F; 264/210.8; 264/211.13; 264/211.14; 264/210.6

[58] Field of Search ..... 264/178 R, 178 F, 177.13, 264/177.19, 210.6, 210.8, 211.14, 211.17, 211.13; 428/400

[56] References Cited

U.S. PATENT DOCUMENTS

| | | | |
|---|---|---|---|
| 3,445,557 | 5/1969 | Horoldt et al. | 264/178 F |
| 3,728,072 | 4/1973 | Orito et al. | 428/400 |
| 3,743,690 | 7/1973 | Lys et al. | 264/178 F |
| 3,790,434 | 2/1974 | Sone et al. | 428/400 |
| 3,822,333 | 7/1974 | Haruta et al. | 264/178 F |
| 3,823,035 | 7/1974 | Sanders | 428/368 |
| 3,944,708 | 3/1976 | Dumas | 428/400 |
| 4,009,511 | 3/1977 | Gauntt . | |
| 4,012,557 | 3/1977 | Cornelis | 428/400 X |
| 4,254,182 | 3/1981 | Yamaguchi et al. | 428/400 |
| 4,451,534 | 5/1984 | Akagi et al. | 428/400 |
| 4,522,873 | 6/1985 | Akagi et al. | 428/400 |
| 4,792,489 | 12/1988 | Kakiuchi et al. . | |

FOREIGN PATENT DOCUMENTS

| | | | |
|---|---|---|---|
| 129317 | 12/1984 | European Pat. Off. | 428/372 |
| 43-22349 | 9/1966 | Japan . | |
| 48-13695 | 2/1973 | Japan . | |
| 55-107512 | 8/1980 | Japan . | |
| 58-16319 | 9/1983 | Japan . | |
| 59-11709 | 3/1984 | Japan . | |
| 823966 | 11/1959 | United Kingdom . | |
| 1546914 | 5/1979 | United Kingdom . | |

OTHER PUBLICATIONS

Hearle, J. W. S., et al., "Fibre Structure", pp. 346–361, 1963.

*Primary Examiner*—Lorraine T. Kendell
*Attorney, Agent, or Firm*—Nixon & Vanderhye

[57] ABSTRACT

A synthetic fiber having an uneven surface structure consisting of wrinkles having ridges and recesses of the surface of the fiber and not presenting specular luster, which may be used, for example, as artificial hair for wigs, can be produced easily and stably by melt-spinning a starting synthetic resin such as nylon and passing the spun monofilament through a cooling bath at a temperature not lower than 30° C. for a period of time sufficient for developing wrinkles in its surface. Inclusion of a pigment such as carbon black in an appropriate amount in the starting material is effective in providing dense distribution of wrinkles.

5 Claims, 13 Drawing Sheets

BATH TEMPERATURE : 80°C X1000

BATH TEMPERATURE : 60°C X1000

BATH TEMPERATURE: 80°C X1000

BATH TEMPERATURE: 60°C X1000

X 1000

BATH LENGTH : 30cm X1000

BATH LENGTH : 50cm X1000

BATH LENGTH : 90cm X1000

X 1000

X 1000

BATH TEMPERATURE :30°C X1000

BATH TEMPERATURE :60°C X1000

BATH TEMPERATURE : 80°C X1000

BATH TEMPERATURE : 30°C X1000

BATH TEMPERATURE :60°C X1000

BATH TEMPERATURE : 80°C X1000

X1000

X1000

X 1000

X1000

SYNTHETIC FIBERS HAVING UNEVEN SURFACES METHOD FOR MELT-SPINNING

This is a continuation of application Ser. No. 07/140,116, filed Dec. 31, 1987, now abandoned, which is a division of Ser. No. 07/941,351 filed Dec. 15, 1986, now U.S. Pat. No. 4,792,489.

BACKGROUND OF THE INVENTION (a) Field of the Invention:

The present invention relates to melt-spun synthetic fibers with formation of unique pattern of wrinkles or ridges and recesses in their surfaces, and also to a method of producing such synthetic fibers, and more particularly it pertains to synthetic fibers having surface configurations resembling those of human hair, and also to a novel method of imparting the synthetic fibers such surface conditions.

(b) Description of the Prior Art:

Those synthetic fibers now being used as the materials of artificial hair for wigs include fibers of the vinyl chloride family and fibers of the acryl family. However, the synthetic fibers of these families, in general, lack resistivity to heat. Therefore, while these synthetic fibers can be relatively easily set with heat, they have a poor holdability of the imparted shape, and accordingly, they have problems in, for example, shampooing with warm water and in drying by means of hair-dryers. On the other hand, those synthetic fibers which are obtained by the melt-spinning process have sufficient resistivity to heat, but, owing to the fact that these synthetic fibers have very smooth surfaces, they present specular luster peculiar to them and give a unique waxy sense, and thus their user cannot help getting dissatisfied with both the feel and the sense of touch of these fibers as they are used for wig hair, and accordingly these synthetic fibers must be said to be far from human hair in property and quality.

There have been reported in the past various methods of supressing and reducing the luster of those synthetic fibers which are obtained by melt-spinning. For the purpose of doing so, there has been widely known technique of introducing an inorganic substance such as silica or titanium oxide in the starting material synthetic resin before being subjected to melt-spinning. While this method is effective in depriving the produced synthetic fibers of their luster, still it is not desirable since the fibers' color-expression is adversely affected.

Japanese Patent Preliminary Publication No. Sho 48-13695 discloses a method of supressing the reflection of light at the surface of the thus-spun synthetic fibers by covering the fiber surfaces with a resin having a low refractive index. Nevertheless, the smoothness of their surfaces are not reduced, and the fibers are substantially short of the sense of touch and feel of human hair.

Various attempts have been developed so far to improve the specular luster of these fibers by causing random or irregular reflection of light by developing uneven pattern in the surface of fibers to thereby improve the feel and sense of touch. For example, Japanese Patent Publication No. Sho 43- 22349 discloses a method of subjecting the surface of the polyamide fiber to dissolution or erosion with an inorganic acid. Japanese Patent Preliminary Publication Nos. Sho 55-107512 and Sho 58- 163718 both disclose methods which are to uniformly diffuse fine particles of an inorganic substance in polyester, and after meltspinning of same, the surface of the resulting filament is subjected to etching with a solvent or an alkaline solution to thereby form an uneven surface. However, such chemical erosion process is intended to develop an uneven surface configuration by developing erosion holes in the surface of the already-made (commercially available) fiber. Accordingly, these fibers are poor in the scratchy sense of the human hair provided by fine projections which the human hair possesses throughout its surface, and also these fibers mentioned above are not suitable for use as the artificial hair to be used in making wigs.

Apart from the above, as a physical surface-reforming technique, Japanese Patent Publication No. Sho 59-11709, for example, discloses a method of imparting a polyester fiber, an uneven surface by subjecting the surface to the irradiation of glow-discharge plasma. This method, however, brings about a rise in the production cost, so that it is not appropriate for the production of artificial hair for wigs.

SUMMARY OF THE INVENTION

It is, therefore, a primary object of the present invention to provide synthetic fibers having an uneven configuration in their surfaces.

Another object of the present invention is to provide synthetic fibers suitable for use as artificial hair especially for wigs.

Still another object of the present invention is to provide a novel method which insures industrially stable production of synthetic fibers having uneven, i.e. wrinkled, surfaces suitable as artificial hair especially for wigs, by a very simplified producing operation and procedure.

The above-mentioned objects are attained, according to one aspect of the present invention, by the provision of synthetic fibers having uneven surface configurations such that, on the external circumference of the fiber in a direction normal to the longitudinal direction of this fiber, there are developed ridges of about 0.2 to 3 in number per $10\mu$ of the circumferential surface, with a space of 3 to $30\mu$ between the adjacent two bottoms defined by adjacent three ridges, and with a distance of about 0.2 to $2\mu$ from the apex to the bottom along the side of any individual ridge.

Furthermore, according to another aspect of the present invention, the above-described objects are achieved by the provision of a synthetic fiber having wrinkled uneven surface configuration such that, between adjacent two ridges, there extends a recessed portion of a length of about 3 to $7\mu$ and a width of about 0.3 to $1\mu$ in the longitudinal direction of the fiber, and these ridges-and-recesses are present in a large number in the surface of each individual fiber along the longitudinal direction thereof.

These as well as other objects, features and advantages of the present invention will become more apparent from the following detailed description of the preferred embodiments of the present invention and from the appended claims when taken in conjunction with the accompanying drawings.

BRIEF DESCRIPTION OF THE DRAWINGS

FIGS. 12A to 12F are electron-microscopic photographs (1000 magnifications) showing the surface appearances of drawn fibers according to the present invention, produced by using Nylon 6 added with carbon black and by changing the temperature of the bath, in which:

FIGS. 12A to 12C show the state wherein the fibers contain 1% by weight of carbon black, and FIGS. 12D to 12F show the state wherein the fibers contain 2% by weight of carbon black.

DETAILED DESCRIPTION OF THE PREFERRED EMBODIMENTS

Figure 1:
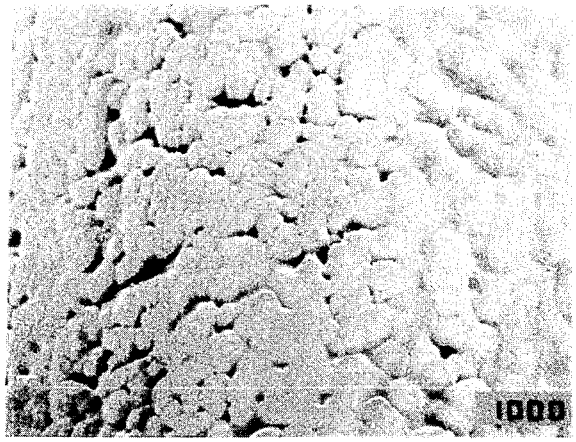
FIGS. 1 and 2 are electron-microscopic photographs (1000 magnifications) showing the surface appearances of undrawn synthetic fibers made of Nylon 6 and obtained according to the present invention.

As a result of various experiments conducted by the present inventors with respect to the method of developing a unique ridge-and-recess surface structure on the surface of a melt-spun mono-filament for the purpose of producting artificial hair for wigs, the inventors have surprisingly succeeded in acquiring synthetic fibers having feel and sense of touch resembling those of the surface structure of human hair and presenting natural luster, by performing the cooling process of the spun filament in warm water and by adjusting the cooling rate. This method, unlike the prior art of giving a surface treatment to an already-made (commercially available) synthetic filament, is based on a completely novel concept to rely only on changing the cooling condition of the melt-spinning process.

According to an embodiment of the present invention, there is provided a method of imparting the surface of a synthetic filament a ridged-and-recessed, or wrinkled, structure, characterized by the process such that, at the time of melt-spinning of a synthetic mono-filament, the spun filament is cooled for a period of time sufficient for causing the development of a ridged pattern in the surface of this mono-filament during its passage through a warm bath at a temperature of not lower than 30° C.

The starting material of the synthetic mono-filament according to the present invention may be any substance so long as it allows melt-spinning. Desirably, however, polyamide resin such as nylon is used as the starting material of the aimed artificial hair. Such nylon includes, for example, Nylon 6, Nylon 6,6, Nylon 6,12 and Nylon 46.

The melt-spinning process according to the present invention resembles the prior art process so far as the general procedures or type of steps are concerned, i.e. the synthetic mono-filament ejected from the spinning nozzle is immediately passed through a bath to cool the filament, and the thus-spun mono-filament is wound around a take-up reel or bobbin. In the embodiments, changing of the time length of passage of the spun filament through the bath is realized by using baths having varied lengths.

However, unlike the conventional art which uses a cold bath for performing quenching of the spun filament, the present invention employs a warm bath. The temperature of the warm bath is such that, in case the mono-filament is made of nylon, an uneven surface configuration can be obtained even at the bath temperature as low as 20° C. The resulting synthetic fiber, however, fails to give a feel and a sense of touch suitable for use as artificial hair. It has been found that, in order to impart a desirable appropriate ridged-and-recessed or wrinkled surface structure to the surface of a spun synthetic mono-filament, the bath temperature and the length of time for the passage of the spun filament through the bath serve as important factors. It has been found also that the higher the bath temperature is and the longer the time of contact of the spun filament with the bath is, the more desirably is developed an aimed uneven surface structure of the filament and the more does this filament lose its luster. The inventors have confirmed that a desirable effect can be obtained from a bath temperature of no lower than 30° C.

The ridges-and-recessed or wrikles of the surface of the spun synthetic mono-filament obtained by the method of the present invention form a random fashion in the entire circumferential surface of the filament. This state of surface is clearly represented in the electron-microscopic photographs (1000 magnifications) of FIGS. 1 and 2. The cause of development of such a surface structure is not known clearly. It is surmised, however, that when those nylon molecules lying in the surface region and being rendered locally to half-molten state and immersed in the warm bath are recrystallized or reagglutinated, and form fine spherical bodies.

Figure 8:
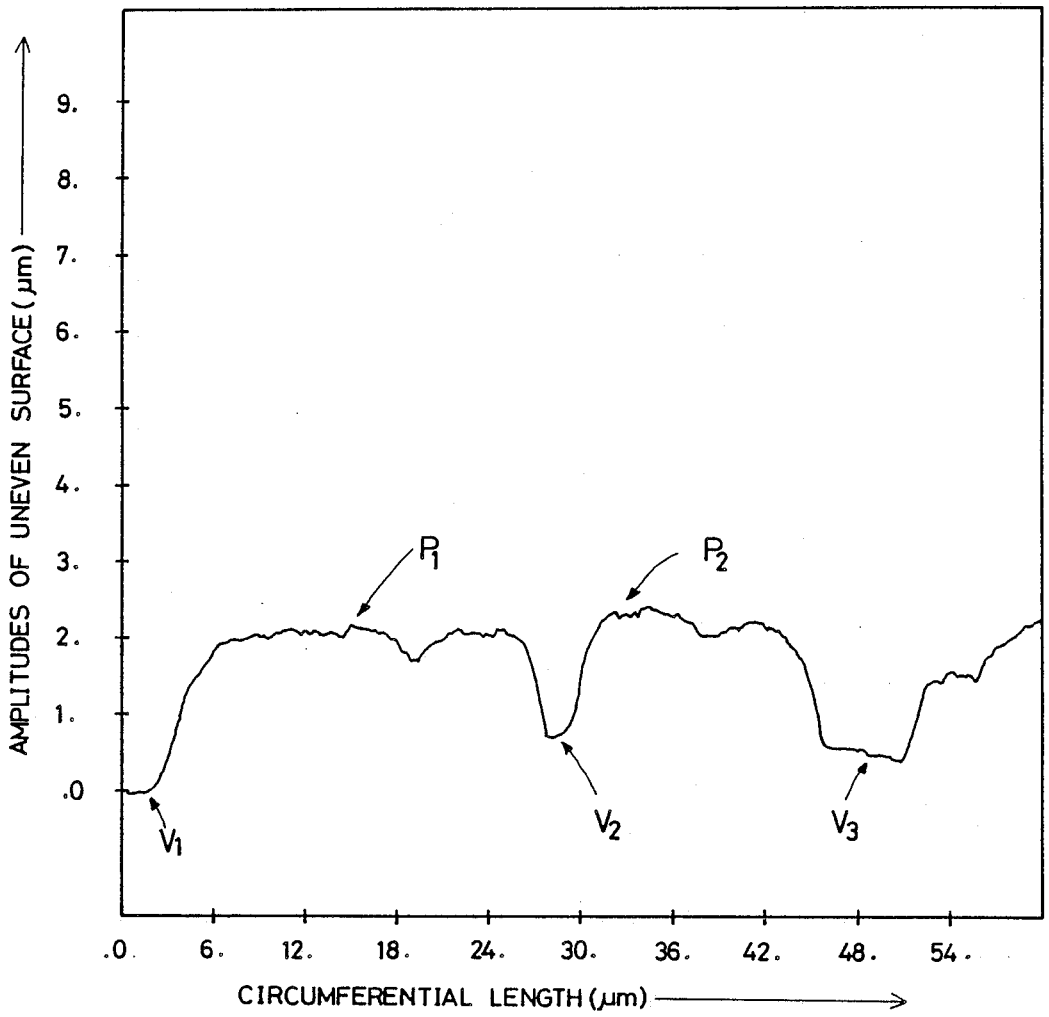
FIG. 8 is a graph showing the relationship between the amplitudes of the ridges developed in the surface and the circumferential length of the fiber of FIG. 1 as measured along the external circumference extending in the direction normal to the longitudinal direction of the fiber.

The uneven surface state of the fiber obtained from such a filament and shown in FIG. 1 and having a ridged pattern is measured along the external circumference of the fiber in a direction normal to the longitudinal direction of this fiber, and the result thereof is shown in FIG. 8. The horizontal axis shows the distances from a certain starting point on said external circumference, while the vertical axis indicates the vertical amplitudes (heights) of the ridges developed in the surface of said circumference. The uneven surface configuration is such that the distance between the two bottoms of any adjacent three ridges is about 20–30μ, and the distance from the apex to the bottom of any ridge along the side surface thereof is about 1.5–2.0μ, and that there is present about 0.2–1 ridge per 10 micrometers of the length of said circumference. The term "apex" herein used is assumed here to point to the top of a relatively large-size ridge (such sites as indicated by $P_1$ and $P_2$ in FIG. 8). The term "bottom of ridge" is assumed herein to denote the bottom of a relatively deep vally between any two ridges (such sites as indicated by $V_1$–$V_3$) in FIG. 8. The ridged pattern noted in the surface was measured by relying on the technique consisting of irradiating the surface with an electron beam and of measuring the reflection thereof.

Figure 9:
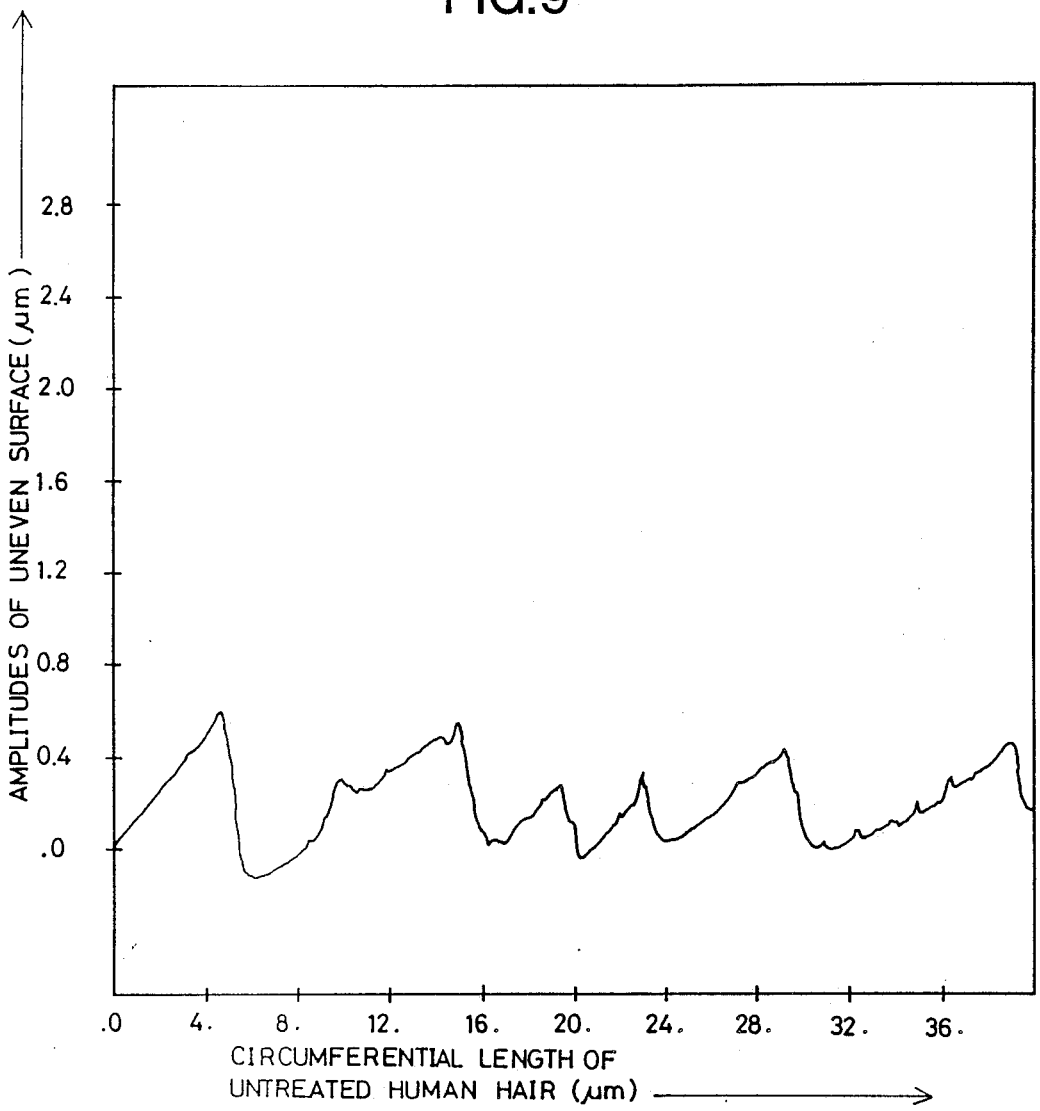
FIG. 9 is a graph showing the relationship between the amplitudes of the surface unevenness relative to the longitudinal distance of the untreated human hair.

For comparison, FIG. 9 is a graph showing the curve of measurement of the ridge-and-recess surface pattern, similar to that of FIG. 8, of a piece of human hair. It should be noted here that, in this graph of FIG. 9, the horizontal axis is indicative of the length of the surface of a piece of hair.

Figure 5:
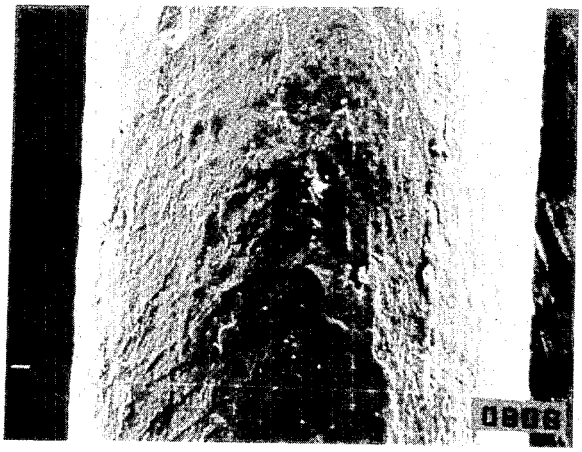
FIG. 5 is an electron-microscopic photograph (1000 magnifications) showing the surface appearance of human hair having been subjected to a surface treatment.

Here, the cuticle of human hair consists of scale-like series of ridges, the outer surface of each piece of hair being such that ridges thereof are aligned in rows extending toward the foremost end of the piece of hair in such a manner of arrangement as noted of bamboo sheaths, overlying part of the adjacent sheaths which lie locally thereunder. Such a state is illustrated in FIG. 9. Ridges and their bottoms are arranged in side-by-side fashion in the direction crossing the longitudinal direction of the piece of hair, thus constituting the surface if a lengthy piece of hair fiber. Moreover, the respective ridges are of such a configuration that the inclination of one side of the ridge is steeper than the slant of the other side of this ridge. The surface configuration of the hair fiber as noted of its longitudinal section shows an alignment in the form of saw-teeth. For this reason, in case a wig is made with pieces of untreated human hair, it should be noted that, when it is intended to implant a piece of human hair to the wig base, these series of saw-teeth-like serrations or ridges will be rendered to a nonaligned state at the site where the piece of hair is folded back or U-turned, with the result that the ridges are entangled with each other and caught by each other, thus making it impossible to form a satisfactory wig. For this reason, when it is intended to use human hair for the formation of a wig, there arises the need to give a surface treatment to slightly smoothen these sawtoothlike series of ridges which are present in the surface of hair. An electron-microscopic photograph (1000 magnifications) of a piece of human hair having been given such a surface treatment is shown in FIG. 5.

Figure 10:
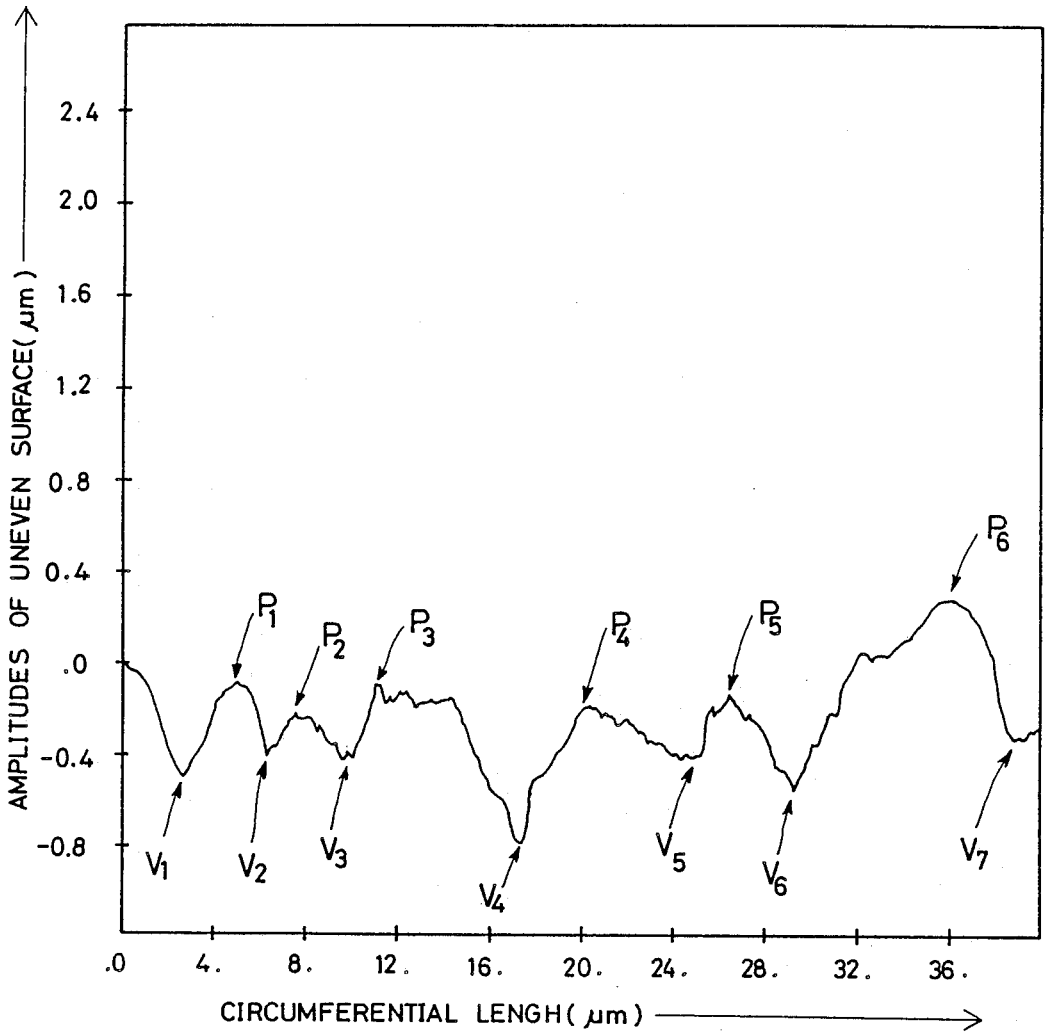
FIG. 10 is a graph showing the relationship between the amplitudes of the ridges of the surface and the length of the external circumference of an undrawn fiber presented in FIG. 12F as measured along the external circumference in a direction normal to the longitudinal direction of this fiber.
Figure 12A:
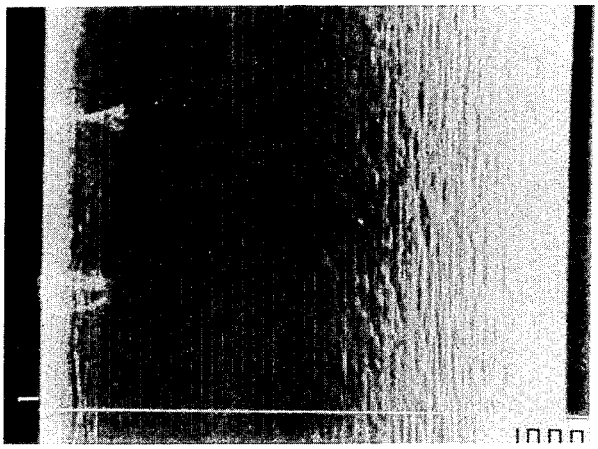
Figure 12B:
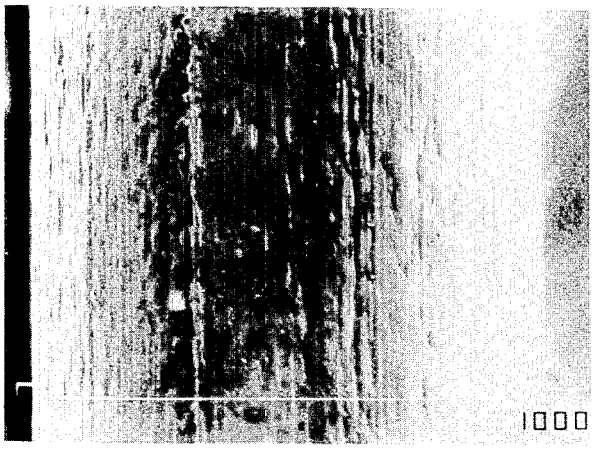
Figure 12C:
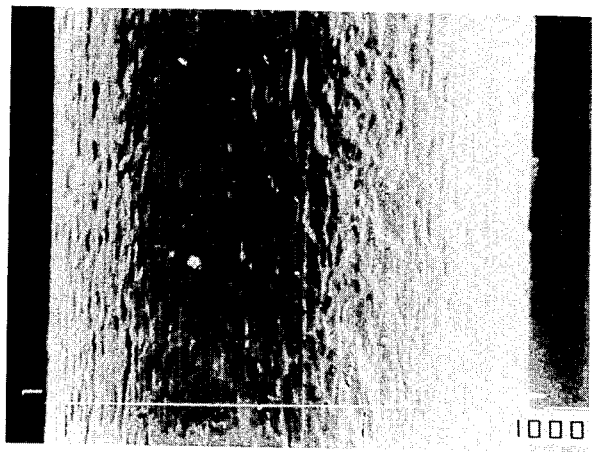
Figure 12D:
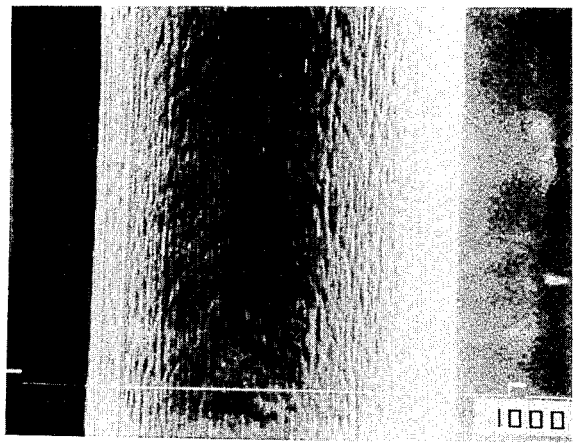
Figure 12E:
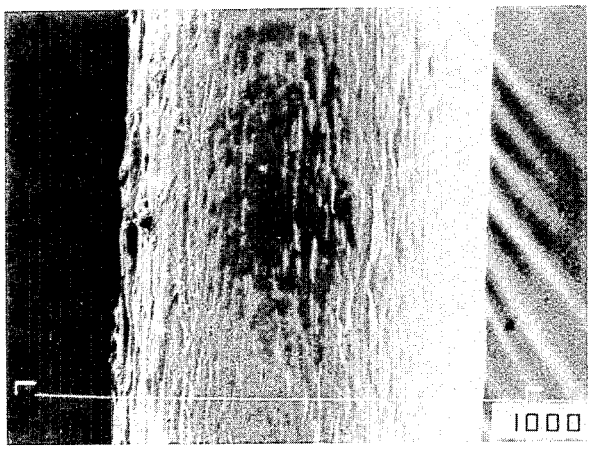
Figure 12F:
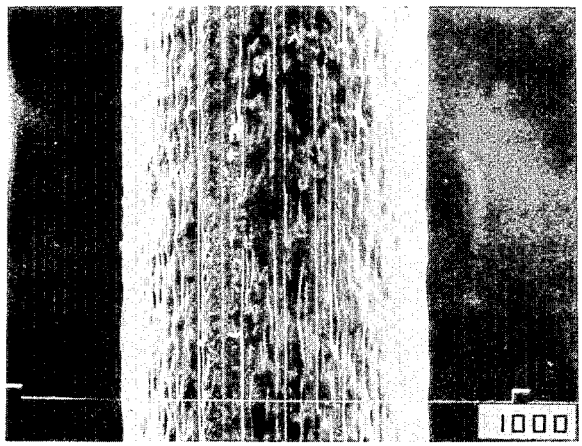

The synthetic fibers of the present invention, as is clear from comparison of FIGS. 9 and 10, present smoother ridged-and-recessed state different from the abovesaid sawtoothwise arrangement of ridges. As a result, these synthetic fibers are free of such drawbacks as stated above which are experienced when pieces of untreated human hair are used. Moreover, because of these ridges-and-recesses at the surfaces of the synthetic fibers, elimination of undesirable surface luster is attained, and thus the synthetic fibers of the present invention can be termed to be superior to human hair to serve as the artificial hair fibers for wigs. It should be noted here that those synthetic fibers having no surface ridges-and-recesses (i.e., smooth even surface structure) possesses luster, and their feel and sense of touch markedly differ from those of human hair, and thus they are not suitable for use as the artificial hair for wigs.

The synthetic fibers produced according to the present invention and having unique ridged-and-recessed or wrinkled structure in their surfaces reflect light in random directions so that the surface luster is rendered to the state that their luster has been practically deprived, and it is thus clear that these fibers represent an improved material for forming wigs. The density of ridges-and-recesses can be freely altered by adjusting the temperature of the cooling bath, the length of time of immersion of the filament in the bath, the type of pigment (carbon black) employed and its volume introduced in the filament material. Especially, when it is intended to use the produced synthetic fibers as the artificial hair wigs, it is possible to provide those hair fibers having such luster and feel that comply with the varied desires of the individual persons. As such, these synthetic fibers are particularly advantageous for the making of wigs. Furthermore, those synthetic fibers which are obtained according to the method of the present invention are here not obtained by developing erosion holes in the surfaces of the fibers as done in the conventional method, but instead they are obtained in such a way that random ridge-and-recess structures are formed as the fibers' own natural patterns, so that they give an appropriate degree of scratchy touch resembling that of the treated human hair. Therefore, when these synthetic fibers of the present invention are used as the hair of a wig, these fibers produce good entanglement with the user's own hair, not presenting extreme distinction from the user's own hair, thus allowing to give a natural look. In case such a resin as nylon which can be melt-spun is used as the material for the production of synthetic fibers, it has a heat-resistivity which, as artificial hair, is by far the superior to those fibers made of a resin of the vinyl chloride family and the fibers made of a resin of the acryl family. These synthetic fibers of the present invention allow shampooing with warm water and the use of hair dryers, and no problem arises in the shape holdability after setting the wig hair made of these fibers.

As described above, according to the method of the present invention, by directly subjecting to cooling, under certain conditions, in a warm bath, the monofilament as it is ejected from a spinning nozzle by relying on the known meltspinning technique, there is imparted, to the filament during the cooling step, a surface structure consisting mainly of randomly distributed unique formation of ridges-and-recesses or wrinkles which cannot be seen from the conventional methods. Also, the method of the present invention has another advantage that the surface structure can be freely adjusted by an arbitrary practice within the limits of the predetermined treating conditions. Moreover, the method of this invention does not require any treatment with a chemical solution nor an expensive treating equipment which are needed in case of the prior art, but instead the method of the present invention allows its practice to be performed in a simplified manner and with safety and stability.

According to another embodiment of the present invention, there is provided a method of imparting wrinkled (ridged-and-recessed) surface structure to the synthetic monofilament, featuring that, at the time of melt-spinning of a synthetic monofilament containing at least 0.5% by weight of carbon black, the spun monofilament is cooled in a warm bath at a temperature not lower than 30° C. for a period of time sufficient for developing the formation of fine ridges-and-recesses in the surface of this monofilament, and also there are provided synthetic fibers having unique wrinkles in the surfaces thereof which are developed by this method.

The melt-spinning technique employed in the present invention follows the conventional procedures, in general terms, excepting certain critical conditions mentioned above, that there is prepared a master batch by mixing carbon black in a synthetic filament material which is conventionally used, and this batch is kneaded together with sufficiently dried chips of a synthetic resin, or there is used colored pellets already containing carbon black therein. The monofilament ejected through the spinning nozzle is immediately passed through a warm bath for cooling purpose, and then it is taken up by relying on the ordinary technique.

In this instant embodiment also, there is developed a ridge-and-recess pattern in the external surface of the filament even at a temperature of as low as about 20° C. of bath. However, especially for the fibers to be used as a hair of wigs, the cooling of the filament through the warm bath requires to be conducted at a temperature not lower than 30° C. It has been found here also that, in order to impart a desirable uneven surface structure to the fibers, the bath temperature and the length of time for the passage of the monofilament through the bath constitute critical factors. It has been confirmed by the inventors that the higher the bath temperature is and the longer the time of contact of this filament with the cooling bath is, the denser becomes the ridge-and-recess or wrinkled structure developed in the surface of the filament becomes, so that undesirable luster of the resulting fibers is deprived, and further that the development of the wrinkled surface is associated also with the amount of carbon black particles which are introduced in the resin which is subjected to melt-spinning. The amount of carbon black is required to be 0.5% or greater by weight in ordinary cases, preferably 1% by weight or greater. In case carbon black particles are introduced in an amount less than 0.5% by weight, no desirable surface structure, i.e. surface structure having densely developed ridges-and-recesses is obtained. In case of nylon synthetic resin fibers, carbon black can be introduced therein in an amount up to 4% by weight. Amounts greater than that will make the spinning difficult to be performed.

In case carbon black is introduced in the resin also, there can be obtained wrinkled surface configuration of the spun fibers similar to that wherein no carbon black is introduced.

FIG. 10 shows the curve showing the ridged surface state of the fibers which have been spun under the conditions employed in the production of nylon fibers containing carbon black as shown in FIG. 2F, i.e. containing 2% by weight of carbon black and passed through a warm bath of 80° C. It should be noted here that, while the photograph of FIG. 2F shows the electronmicroscopic photograph of a drawn fiber, FIG. 10 shows the surface configuration of a fiber before being drawn. Alike the instance of FIG. 8, it is assumed here that the tops of relatively large-size ridges as at $P_1$–$P_6$ constitute the apexes of ridges, and the bottoms of the recesses which are relatively deep as indicated by $V_1$–$V_7$ constitute here the bottoms of valleys between two ridges, the distance between adjacent bottoms of valleys is about 3–10 μ, while the distance from the apex of a ridge and the bottom of this ridge along the side surface thereof is about 0.2–1 μ, and there are one to three ridges present per 10 micrometers along the external circumference.

Accordingly, when speaking, in general, of the instance wherein carbon black is contained and the instance where no carbon black is contained, the ridge-and-recess surface configuration which is obtained according to the method of the present invention can be concluded that the interval between adjacent two bottoms of valleys is 3–30 μ, the distance from the apex of a ridge to the bottom of this ridge is 0.2–2 μ, and there are present about 0.2–3 ridges per 10 micrometers along the circumference.

According to still another embodiment of the present invention, the melt-spun synthetic monofilament having surface wrinkles which are developed as the filament is passed through a warm bath for its cooling and is taken up around a reel is further subjected to drawing, thus providing a synthetic fiber having a wrinkled surface such that the initial ridge-and-recess configuration is extended in the direction of the drawing to be turned into a pattern presenting elongated ridges and bottoms of valleys in the longitudinal direction of the filament. In this embodiment, the drawing rate is about 2–5 times the original length, preferably 2.5–3.5 times. Let us here assume that, by this drawing, there are formed ridges having a width of 1–5 μ rising from the surface of the external circumference of the filament and being randomly distributed on the entire circumferential surface, thus constituting a wrinkled surface structure of the spun monofilament obtained by cooling according to the conditions set by the present invention. There are noted the formation, between two ridges extending in the longitudinal direction of the filament, of recessed portions of a length of 3–7 μ and also recessed portions of a width of 0.3–1 μ in the direction normal to the longitudinal direction of the filament, as a result of drawing. Also, there are noted random development, in the direction normal to the longitudinal direction of the flament, ridged portions of a length of 3–7 μ and a width of 0.3–1 μ and also of round-shaped recessed portions of a diameter of 0.5–1 μ which are surrounded by the above-mentioned ridges, respectively. This state will be presented in the attached electron-microscopic photograph (1000 magnifications).

Description will hereunder be made of the present invention by some examples which use Nylon 6 and Nylon 6,6 as the typical atarting material resin. The nylon resins used herein have been obtained from Mitsubishi Kasei Kabushiki Kaisha.

EXAMPLE 1

Chips of the starting material Nylon 6 (mean molecular weight being 23500) were subjected to melt-spinning under the below-mentioned conditions:

| | |
|---|---|
| Diameter of spinning nozzle | 1 mm |
| Take-up speed | 400 m/minute |
| Draft ratio determined by ejection speed and take-up speed | 37 |
| Bath length | 130 cm |

-continued

| | |
|---|---|
| Bath temperature | 30–80° C. ± 1.5° C. |

Figure 2:
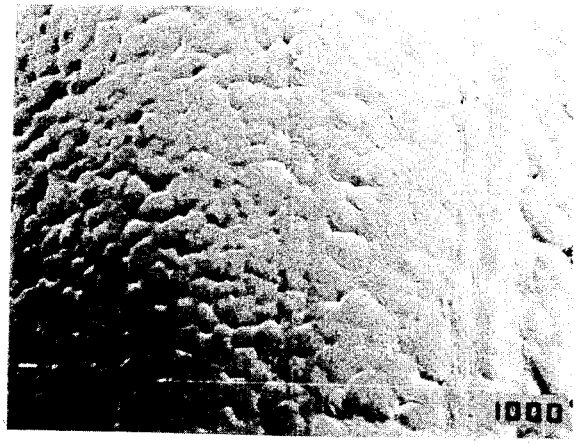
Figure 3:
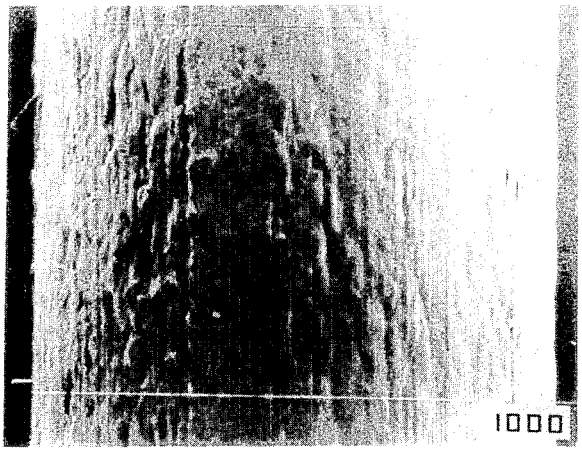
FIGS. 3 and 4 are electron-microscopic photographs (1000 magnifications) similar to those of FIGS. 1 and 2, but showing the surface appearances of the fibers of FIGS. 1 and 2 after being drawn.
Figure 4:
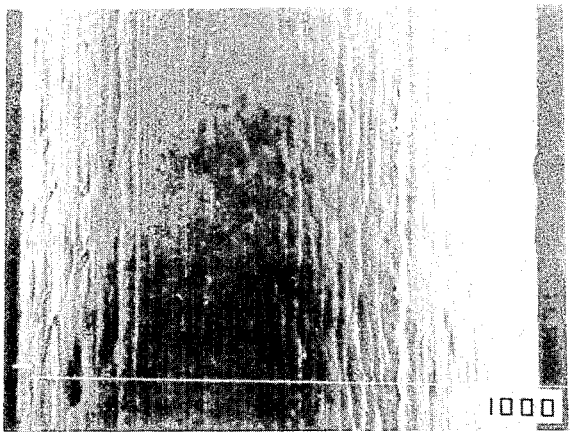

The surfaces of the produced fibers were observed by an electron-microscope (1000 magnifications). FIGS. 1 and 2 are photographs showing the surface state of the fibers before being drawn, and FIGS. 3 and 4 are similar photographs showing the surface state of the fibers after being drawn. As will be clear from these photographs, it is noted that the surfaces of those fibers obtained according to the method of the present invention are such that those fibers prior to being drawn present embossedform of wrinkled appearance, while those fibers having been drawn present wrinkled pattern closely resembling the pattern similar to the state of human hair which has been subjected to a surface treatment as shown in FIG. 5.

Also, the degree of luster at the surface of the fibers shows such characteristics as shown in the following Table 1 depending on the different degrees of temperature of bath. This Table gives the result of sensual evaluation, which bespeaks that the luster is reduced as the bath temperature rises. That is, the fibers are deprived of their luster, and have become desirable as artificial hair for wigs.

TABLE 1

| Bath temperature (°C.) | 20 | 30 | 40 | 50 | 60 | 70 | 75 | 80 |
|---|---|---|---|---|---|---|---|---|
| Evaluation | Δ | ○ | ⊙ | ⊙ | ◎ | ◎ | ◎ | ◎ |

◎ : removed quite satisfactorily
⊙: removed well
○ : removed fairly well
Δ: not removed well Furthermore, comparison of physical property values between the fibers of the present invention and human hair is shown in Table 2.

TABLE 2

| | Bath temp. (°C.) | Diameter (mm) | Elasticity (kgf/mm$^2$) | Breaking strength (kgf/mm$^2$) | Elongation rate (%) | Breaking energy (kgf-mm) |
|---|---|---|---|---|---|---|
| Fibers of the invention | 30 | 0.1 | 324 | 45.2 | 37.2 | 11.1 |
| | 60 | 0.1 | 350 | 47.7 | 34.0 | 11.4 |
| | 80 | 0.1 | 425 | 59.6 | 29.8 | 7.6 |
| Human hair (treated) | | 0.07 | 456 | 23.5 | 39.8 | 3.16 |

From the above Table 2, it is noted that the fibers according to the present invention present no inferiority when compared with the treated human hair which is used for wigs. It has been found that the synthetic fibers of the present invention can be sufficiently used especially as artificial hair for wigs, in such aspects also as strength, elasticity and elongability.

EXAMPLE 2

Chips of Nylon 6 which constitutes the same starting material as the one used in Example 1 were used, and observation was conducted of the produced filaments obtained by changing the length of bath, with respect to how the ridge-and-recess surface structure would change by the difference in the length of time of immersion of the spun filament in a warm bath. It should be understood that the bath temperature employed in this Example was 85° C., whereas the take-up speed was the same as that employed in Example 1.

Figure 6A:
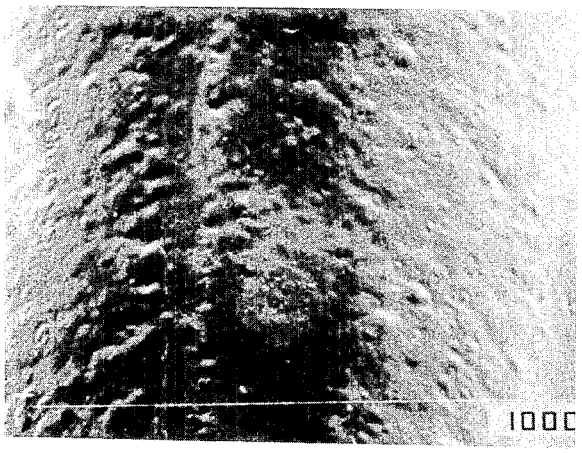
FIGS. 6A, 6B and 6C are electron-microscopic photographs (1000 magnifications) of the surface configurations of undrawn Nylon 6 filaments according to the present invention obtained by changing the time length of passage of the synthetic filaments through a bath.
Figure 6B:
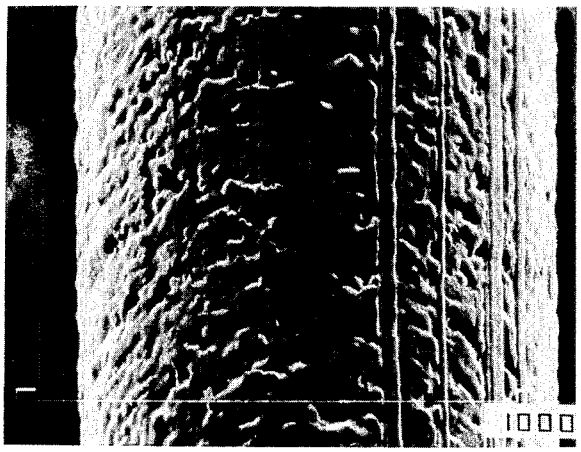
Figure 6C:
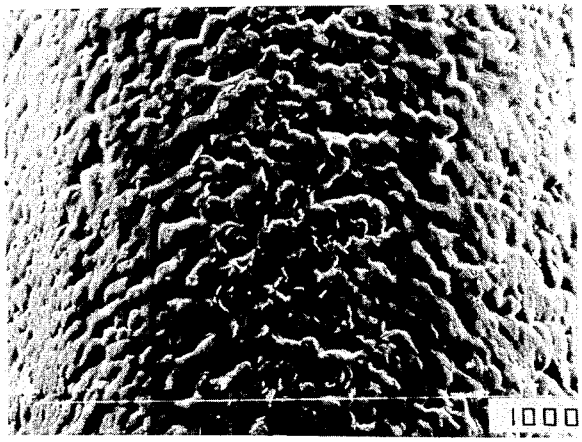

Electron-microscopic photographs (1000 magnifications) of these respective fibers thus obtained in Example 2 are shown in FIGS. 6A, 6B and 6C. The lengths of bath employed are: 30 cm (FIG. 6A), 50 cm (FIG. 6B), and 90 cm (FIG. 6C), respectively.

The result is such that, the greater the bath length is, i.e. the greater the time length if immersion is, more prominent does the developed ridge-and-recess surface structure become, while a short length of immersing time gives a coarsely wrinkled surface structure. Also, reflection of light changes with the density of the developed wrinkled surface structure, so that it has been known also that there occur changes in the luster also.

EXAMPLE 3

Figure 7:
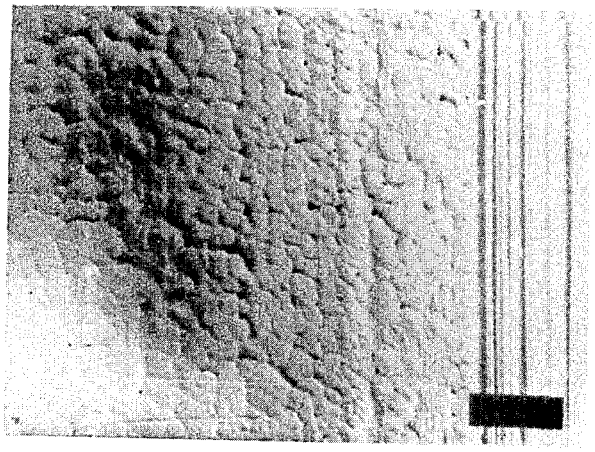
FIG. 7 is an electron-microscopic photograph (1000 magnifications) showing the surface appearance of an undrawn Nylon 6,6 synthetic filament according to the present invention.

Chips of the starting material Nylon 6,6 (mean molecular weight being 25000) were subjected to melt-spinning under the same conditions as those used in Example 1 excepting that the bath temperature was set at 95° C. The resulting ridge-and-recess surface pattern is shown in FIG. 7. The physical property value could acquire a result which was in a level similar to the physical property value of human hair as in the case of Nylon 6.

EXAMPLE 4

Figure 11:
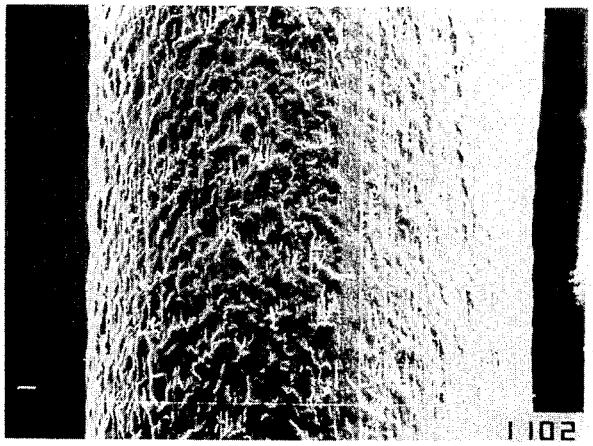
FIG. 11 is an electron-microscopic photograph (1000 magnifications) showing the surface appearance of a drawn fiber according to the present invention which is produced by using a mixture of Nylon 6 and carbon black.

A master batch was prepared by mixing, into the starting material Nylon 6 (mean molecular weight being 23500), 10% by weight of furnace type carbon black (tradename PAM (F) 37 Black, having particle size of 30μ or less and containing a small amount of additive) obtained from Dainichi Seika Kogyo Kabushiki Kaisha. By using the material Nylon 6 which has been adjusted of its mixing ratio so as to obtain the final content of pigment of 2% by weight, melt-spinning was conducted. The monofilament jutted out from the spinning nozzle was immediately passed through a warm bath at 85° C. and then was taken up (the draft ratio determined by the jutting-out rate and take-up speed being 37.0). The bath length was 130 cm. Subsequently, the taken-up filament was drawn to 3 times the original length. The surface state was observed by a scanning type electron-microscope, and the photograph thereof is shown in FIG. 11.

Comparison of the physical property of this product with that of the conventional artificial hair and with that of human hair having been used for wigs is shown in the following Table 3.

TABLE 3

| | Diameter (mm) | Elasticity (kgf/mm$^2$) | Breaking strength (kgf/mm$^2$) | Elongation (%) | Breaking energy (kgf-mm) |
|---|---|---|---|---|---|
| Human hair | 0.08 | 456 | 23.5 | 40.0 | 3.16 |
| Artificial hair made of vinyl chloride* | 0.08 | 366 | 20.8 | 100.0 | 4.43 |
| Artificial hair made of acryl resin** | 0.08 | 548 | 40.8 | 29.3 | 1.69 |
| Fibers of the invention | 0.08 | 450 | 50.0 | 43.0 | 5.5 |

*tradename—Teviron
**tradename—Kanekalon

As shown in the photograph of FIG. 11, it is noted that ridges-and-recesses or wrinkles are developed in random fashion in the surface of the fiber. Due to these random style ridges-and-recesses, the reflection of light which impinges onto the surface of the fiber is reflected in random directions and thus the specular luster noted of the prior art fibers disappears.

Also, the physical property of the fibers obtained according to the present invention has been found to present no inferiority to the conventionally used fibers of the vinyl chloride family and those of the acryl family, and to human hair which has been conventionally used for wigs, as shown in Table 3. It has been thus known that the fibers of the present invention can be used sufficiently satisfactorily as artificial hair especially for wigs in such viewpoints also as strength, elasticity and elongation.

EXAMPLE 5

Using a master batch prepared in Example 4, and using a bath of the same length as that employed in Example 4, melt-spinning was conducted, with the same take-up speed, of chips of the starting material Nylon 6 which had been mixed with carbon black and adjusted so that the final carbon black content became 0.5, 1.0, 1.5, 2.0 and 2.5, respectively. During the spinning operation, the bath temperature was varied in a range of 30°–80° C. The resulting fibers were observed of their luster at the surfaces, respectively, and their degrees of luster were evaluated by sensual evaluation. The result is shown in Table 4.

TABLE 4

| Bath temperature (°C.) | | 20 | 30 | 40 | 50 | 60 | 65 | 70 | 75 | 80 |
|---|---|---|---|---|---|---|---|---|---|---|
| Carbon black* content (%) | 0.5 | X | X | X | X | Δ | Δ | Δ | Δ | Δ |
| | 1.0 | X | Δ | Δ | Δ | Δ | ○ | ○ | ⊙ | ◎ |
| | 1.5 | X | Δ | Δ | Δ | ○ | ○ | ○ | ⊙ | ◎ |
| | 2.0 | Δ | ○ | ○ | ⊙ | ⊙ | ⊙ | ◎ | ◎ | ◎ |
| | 2.5 | Δ | ⊙ | ⊙ | ⊙ | ⊙ | ◎ | ◎ | ◎ | ◎ |

Evaluation
◎: removed quite satisfactorily
⊙: removed well
○: removed fairly well
Δ: not removed well
X: not removed
*PAM (F) 37 Black (made by Dainichi Seika Kogyo Kabushiki Kaisha)

As shown in Table 4 above, it is noted that, the greater the content of carbon black is, and the higher the bath temperature is, the more does the luster disappear. However, when the bath temperature is lower than 30° C. or in case the carbon black content is less than 0.5% by weight, there is hardly demonstrated the effect of development of unique ridge-and-recess surface structure even by adjusting the bath temperature below that level. From this fact, carbon black seems to be an important factor for the development of dense ridges-and-recesses in the surface of fibers. Accordingly, presence of particles of carbon black in an amount of, preferably, 1% by weight or more is necessary. It is extremely convenient that the effect of the present invention can be displayed sufficiently by the standard amount of addition of pigment, which is 2–2.5% by weight.

It should be noted here that the results shown in Table 1 and Table 4 represent the results of gross observations conducted with respect to the degree of removed luster, from the viewpoint that the fibers of the present invention will be used as artificial hair for wigs. Comparing these Tables, it must be considered that, in addition to the degree of development of ridges-and-recesses in the surface of a fiber, the gross observations are affected, in case no carbon black is introduced, due to the degree of opacification of the fibers, and in case carbon black is introduced, by the difficulty of eliminating luster attributable to the blackening of the color of the fiber. Thus, it is not appropriate to attempt direct connection of Table 1 to Table 4.

Electron-microscopic photographs (1000 magnifications) of the typical specimens mentioned above are shown in FIGS. 12A to 12F.

From these photographs, it is known that those fibers whose luster has been better deprived present clearly that the surface ridges are developed more densely.

EXAMPLE 6

Figure 13A:
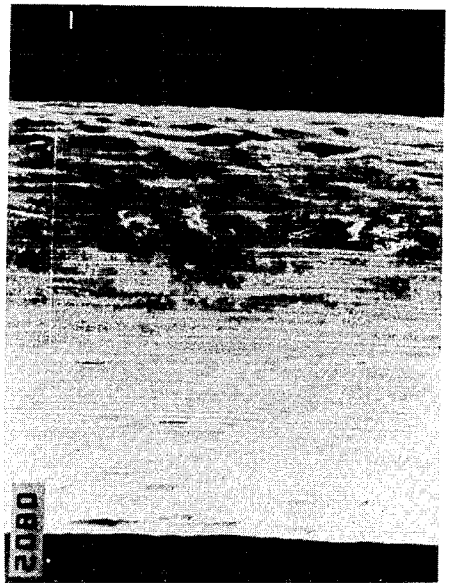
FIGS. 13A to 13C are electron-microscopic photographs (1000 magnifications) of the surface appearances of the drawn fibers according to the present invention, produced by using Nylon 6 added with carbon black and by changing the length of bath.
Figure 13B:
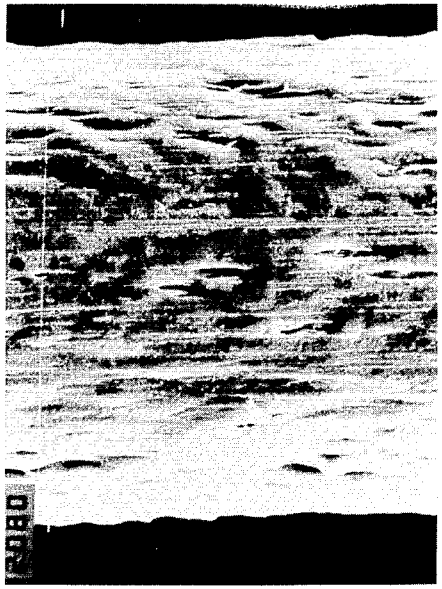
Figure 13C:
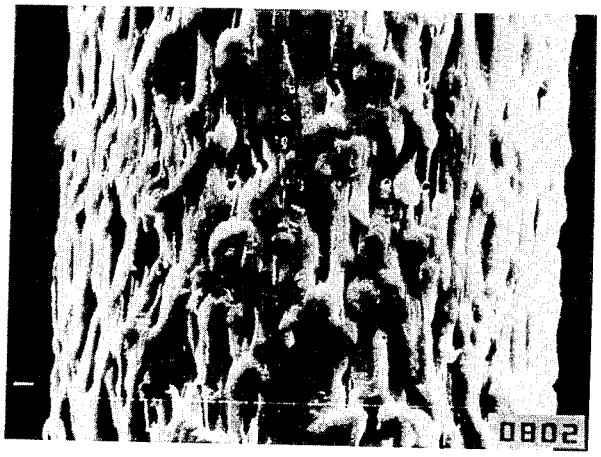

Chips of starting material Nylon 6 were mixed with the master batch prepared in Example 4, and the resulting mixture which had been adjusted of the carbon black content to 1.5% by weight was melt-spun by changing the length of bath, and the resulting product filaments were subjected to observation as to how the surface ridge configuration underwent changes due to the difference in the length of time of immersion in the warm bath. The bath temperature was 85° C., and the take-up speed was the same as that in Example 4. Electron-microscopic photographs (1000 magnifications) of the respective product fibers are shown in FIGS. 13A to 13C. Bath lengths are: 90 cm (FIG. 13A), 110 cm (FIG. 13B), and 130 cm (FIG. 13C).

As a result of the observation, it is known that, the greater the length of bath is, i.e. the greater the immersion time length is, the more do ridges and recesses develop, while immersion for a short length of time does not bring about the development of ridges-and-recesses in good amount. Also, because of the fact that the random reflection of light differs depending on the size of the ridges-and-recesses, there are noted changes in luster.

EXAMPLE 7

Figure 14:
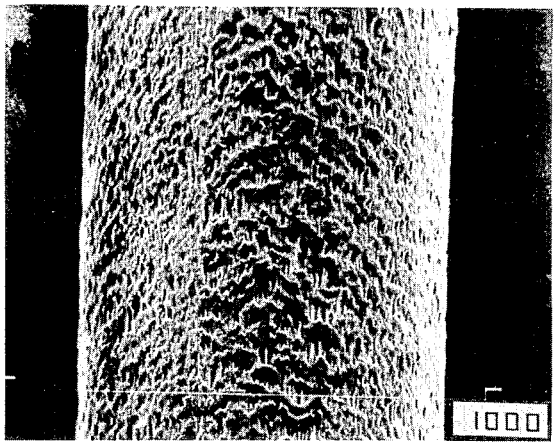
FIG. 14 is an electron-microscopic photograph of the surface appearance of the drawn fiber according to the present invention, obtained by using Nylon 6,6 added with carbon black.

A master batch was prepared by mixing, in Nylon 6,6 (mean molecular weight being 25,000), 10% by weight of carbon black which was same as that employed in Example 4. Melt-spinning was conducted of the starting material obtained by mixing carbon black in Nylon 6,6 and adjusted so that the final carbon black content was 2% by weight. The filament jutted out from the spinning nozzle was immediately passed through a warm bath at 95° C. and was taken up (draft ratio determined by jutting-out rate and take-up speed being 37.0). The bath length was 130 cm. Subsequently, the taken-up filament was drawn to 3 times the original length. The surface state of the resulting filament was observed by a scanning type electron-microscope (1000 magnifications) and the photograph thereof is shown in FIG. 14. As will be apparent from FIG. 14, it is known that, similarly to the instance of Nylon 6, there are formed dense ridges-and-recesses in random fashion in the surface of the filament. Also, there was obtained a property value which was substantially the same as that of Nylon 6.

Description has been made above of the synthetic fibers obtained according to the method of the present invention, with respect to instances just as an example in which they are used as artificial hair for the making of wigs. It should be noted, however, that the present invention is not limited to the making of synthetic fibers only for the use in making wigs, but that the present invention is applicable also to many other purposes as will be needles to say.

What is claimed is:

1. A method of producing a polyamide fiber having an uneven surface structure consisting of ridges and recesses on the surface of said fiber, comprising the steps of melt-spinning a melt-spinnable polyamide resin to form a fiber, and immediately passing said fiber through a cooling bath consisting of warm water at a temperature of at least 30° C. for a period of time sufficient to develop a ridge-and-recess pattern on the entire external circumferential surface of said fiber such that (i) each pair of adjacent recesses have their respective bottoms spaced apart from each other at an interval of about 3 to 30$\mu$, as measured along an external circumference of the fiber in a plane normal to a longitudinal axis of the fiber, (ii) the apex to bottom distance of any ridge as measured in a direction normal to the longitudinal axis of the fiber is about 0.2 to 2$\mu$, and (iii) about 0.2 to 3 ridges are present per 10$\mu$ along said external circumference in said plane, whereby said fiber having said uneven surface structure is produced.

2. A method according to claim 1, wherein said polyamide is a nylon selected from the group consisting of Nylon 6, Nylon 6,6, Nylon 6,12 and Nylon 4,6.

3. A method according to claim 1, wherein said melt-spinnable polyamide resin contains between about 0.5 to 4% by weight carbon black having a particle size of about 30$\mu$ or smaller in diameter.

4. A method according to claim 3, wherein said carbon black is present in an amount of about 1 to 2.5% by weight.

5. A method according to claim 1, further comprising the step of drawing the cooled monofilament.

* * * * *